US006227479B1

(12) United States Patent
Dean et al.

(10) Patent No.: US 6,227,479 B1
(45) Date of Patent: May 8, 2001

(54) SEALING STRIP SEPARATION FILM RETRIEVER AND METHOD

(76) Inventors: William L. Dean, 134 Doud Rd.; David L. Doud, 305 Doud Rd., both of Kawkawlin, MI (US) 48631

( * ) Notice: Subject to any disclaimer, the term of this patent is extended or adjusted under 35 U.S.C. 154(b) by 0 days.

(21) Appl. No.: 09/417,566

(22) Filed: Oct. 14, 1999

(51) Int. Cl.[7] ..... B65H 18/10; B65H 75/24; B65H 75/40

(52) U.S. Cl. ..... 242/546.1; 242/405.3; 242/571.4; 242/573.2; 242/598.1; 156/344

(58) Field of Search ..... 242/546.1, 539, 242/571.4, 571.5, 405.3, 407.1, 599.1, 573, 573.2, 598.1

(56) References Cited

U.S. PATENT DOCUMENTS

| | | | | |
|---|---|---|---|---|
| 606,666 | * | 7/1898 | Hubner | 242/405.3 |
| 774,937 | * | 11/1904 | Cramer | 242/598.1 |
| 1,199,790 | * | 10/1916 | Holcomb | 242/405.3 |
| 1,553,873 | * | 9/1925 | Morosco | 242/405.3 |
| 2,615,644 | * | 10/1952 | Enz | 242/573 |
| 2,869,800 | * | 1/1959 | Eden | 242/546.1 |
| 3,185,407 | * | 5/1965 | Lichtenstein | 242/405.3 |
| 3,936,343 | * | 2/1976 | Walls | 156/584 |
| 5,465,922 | * | 11/1995 | Groef | 242/573 |
| 5,686,179 | | 11/1997 | Cotsakis et al. . | |
| 5,733,621 | | 3/1998 | Cotsakis et al. . | |
| 6,004,426 | * | 12/1999 | Johnson | 156/344 |

* cited by examiner

*Primary Examiner*—John M. Jillions
(74) *Attorney, Agent, or Firm*—Reising, Ethington, Barnes, Kisselle, Learman & McCulloch, P.C.

(57) ABSTRACT

The sealing strip separation film retriever has a tubular spindle with first and second ends and an inside diameter. A plurality of slots in the spindle extend from the second end toward the first end and form fingers. A first end plate is secured to the first end of the spindle. A hand crank is secured to the first end plate. A shaft carries a second end plate and a spindle support block. The spindle support block is telescopically received in the spindle and supports the fingers. A support handle, with a joint, is journaled on the hand crank and on the shaft.

8 Claims, 2 Drawing Sheets

SEALING STRIP SEPARATION FILM RETRIEVER AND METHOD

TECHNICAL FIELD

This invention relates to a separation film retriever and more particularly to an apparatus for removing a separation film from a sealing strip that creates a seal between two overlapping sheet of rubber roofing material.

BACKGROUND OF THE INVENTION

Roofs on industrial buildings are frequently covered by a membrane made from a rubber like material. These membranes form a watertight cover that lasts for a number of years and can be applied in a short period of time. Flat roofs as well as roofs with a slope are covered by these rubber membranes.

Rubber sheets for constructing a roofing membrane are formed and then rolled. Each roll of rubber sheet material is generally four to eight feet wide or so and can be several hundred feet long. For use on large buildings, the sheet material can be more than eight feet wide.

A roll of rubber roofing material is lifted to a roof and then unrolled on the roof with one edge overlapping an edge of another sheet of rubber roofing material. The overlap is generally about three to nine inches. The overlapping edge is then folded over to expose the overlapped edge.

A roll of adhesive material is then unrolled on the exposed overlapped edge. This adhesive material is a rubber like compound that is deposited on a strip of separation film and then rolled up. These adhesive material and separation film rolls are generally 2, 4, 6 or 8 inches wide. The separation film strip is on top of the adhesive material strip after the roll is unrolled. The separation film is then removed from the upper surface of the adhesive material strip and the overlapping edge of roofing material is unfolded and placed in contact with the adhesive material strip. A roller applies pressure to the overlapping edge to form a watertight seal between the overlapped edge and the overlapping edge.

The separation film is currently wadded up and stuffed into plastic bags as it is removed from the adhesive material. A plastic bag holds a limited quantity of the wadded up strip of separation film. It is therefore necessary to contain and store a number of plastic bags filled with separation film on the roof until they can be carried to the ground for disposal.

Occasionally wind catches an unsecured strip of separation film material and carries it off the roof. These strips of loose separation film are difficult to retrieve for proper disposal once they are blown off the roof and scattered around on the ground.

Plastic bags are somewhat expensive. Disposal of plastic bags is also a problem. Most plastics are made from hydrocarbons and may require several decades to disintegrate in a landfill. If incinerated, toxic gases may be formed from plastic bags thereby creating additional environmental problems.

SUMMARY OF THE INVENTION

The sealing strip separation film retrieve tool includes a drum with a tubular spindle. A first end plate is permanently secured to a first end of the spindle. A crank is secured to the first end plate and extends axially outward from the first end plate and the spindle. A first handle section is journaled on a first arm of the crank.

A plurality of slots are formed in the spindle and extend from a second spindle end toward the first end plate. A shaft has an inner end, at least one integral spindle support block on the inner end, and a second end plate fixed to a portion of the shaft. A second handle section is journaled on an outboard end of the shaft.

The at least one integral spindle support block is telescopically received in the spindle and the second handle section engages the first handle section when the drum is assembled for use. The integral spindle support block is disengaged from the spindle and the second handle section disengages from the first handle section when the drum is disassembled for discharging separation film rolls.

BRIEF DESCRIPTION OF THE DRAWINGS

The presently preferred embodiment of the invention is disclosed in the following description and in the accompanying drawings, wherein.

DESCRIPTION OF THE PREFERRED EMBODIMENT

Figure 1:
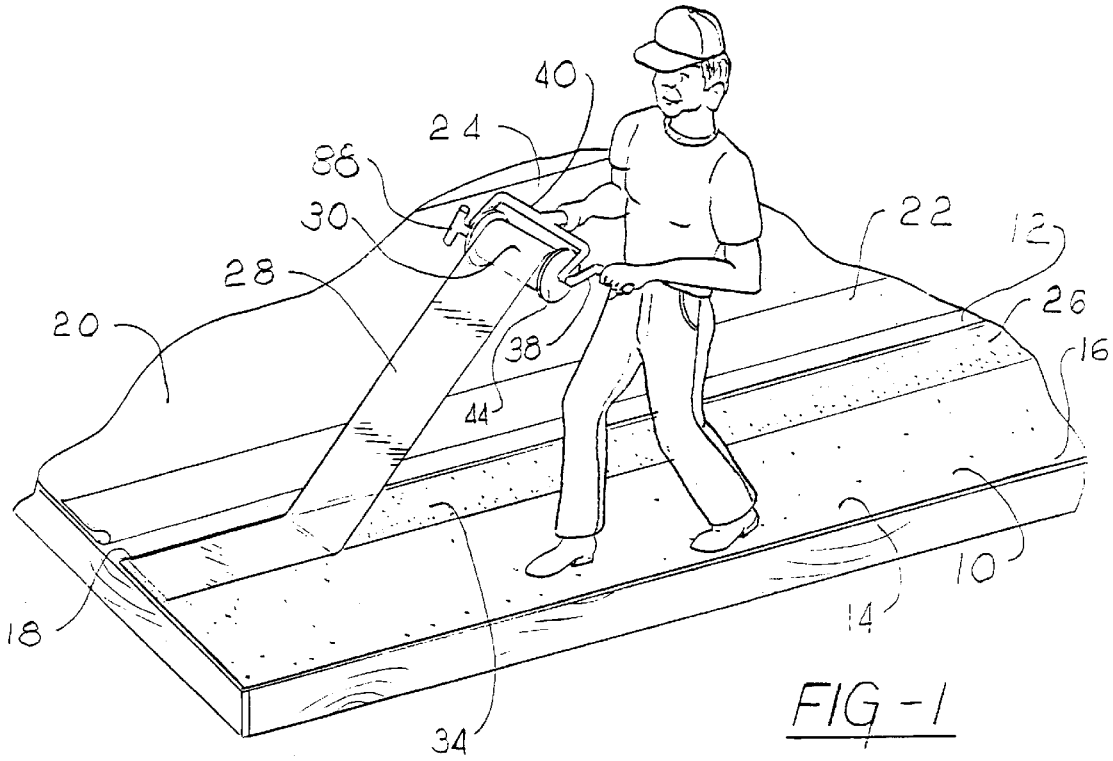
FIG. 1 is a perspective view of the rubber roofing application tool in use.
Figure 2:
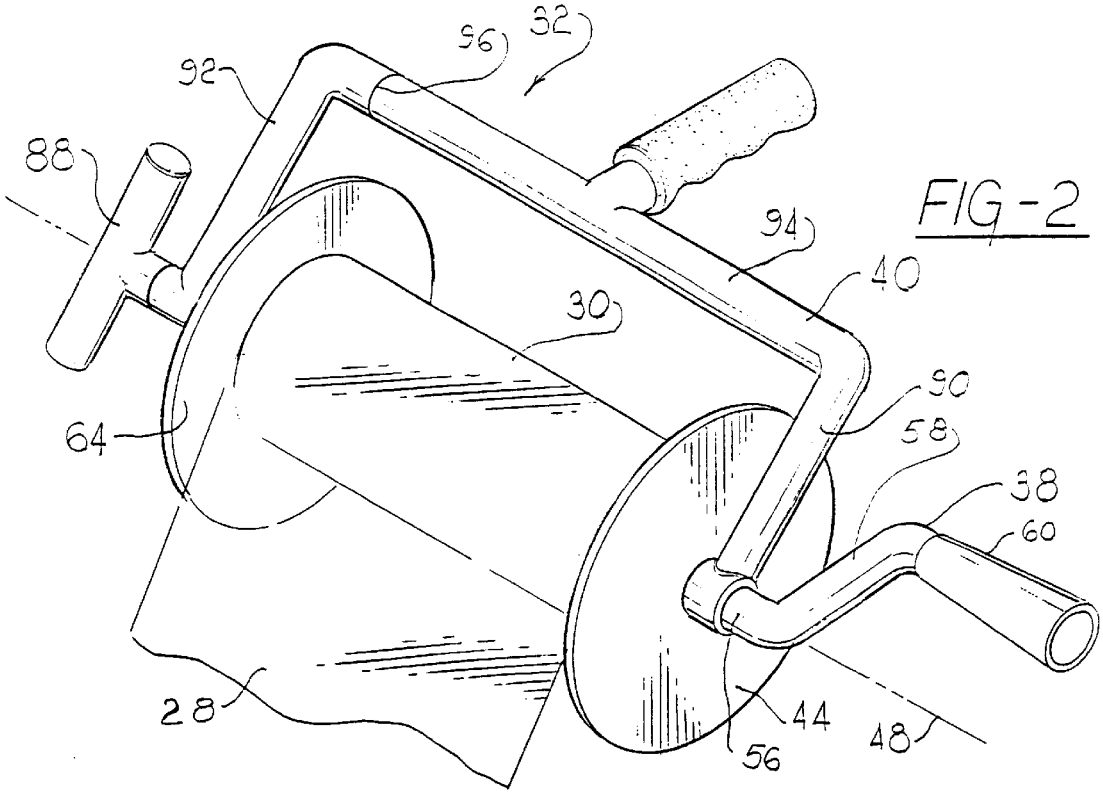
FIG. 2 is an enlarged perspective view of the separation film retrieving and rolling tool in use.
Figure 3:
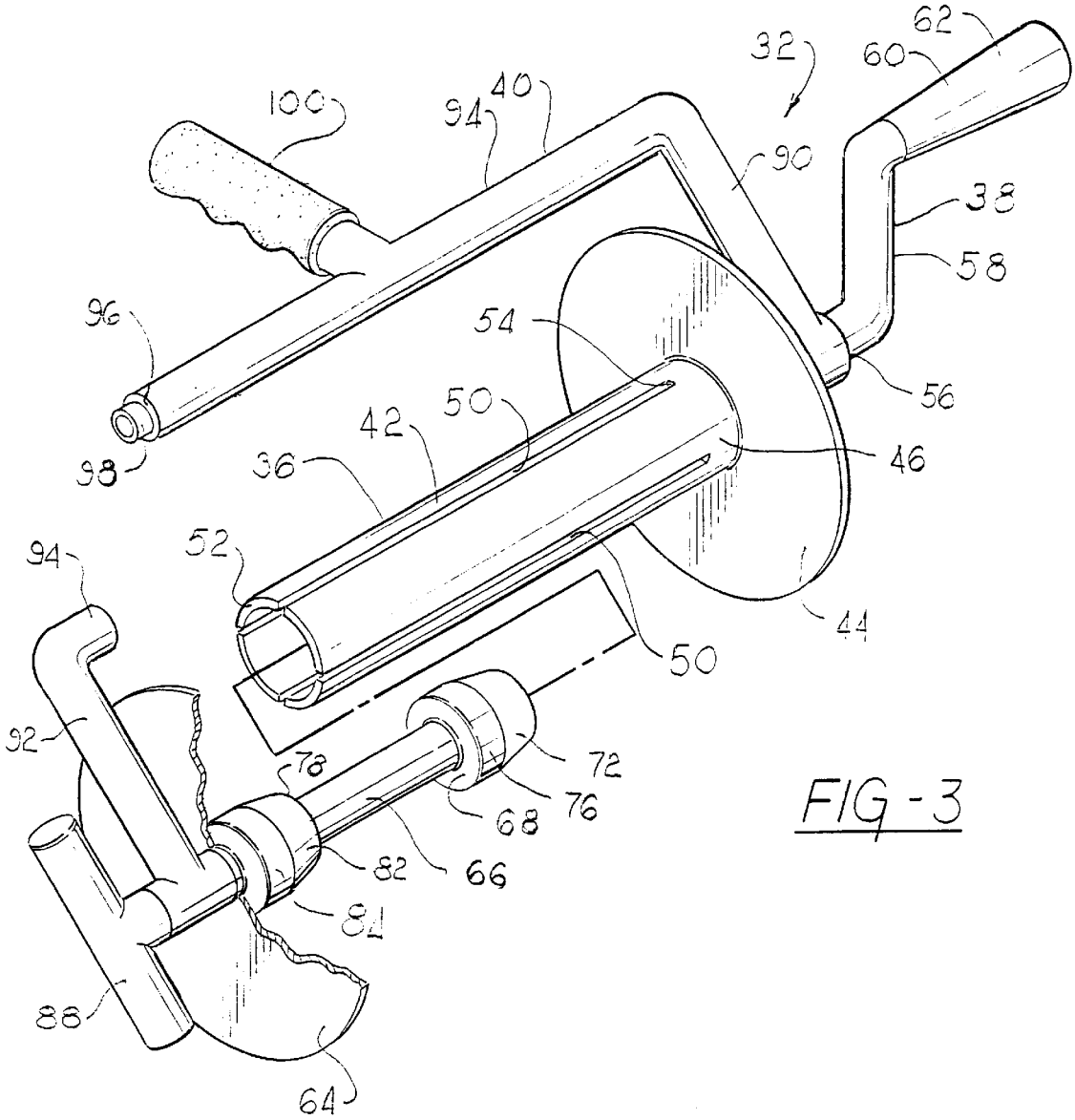
FIG. 3 is an expended perspective view of the separation film retrieving and rolling tool.

Rubber sheet material 10 is applied to the roof 12 of a building by unrolling a first sheet 14 of rubber roofing material with a first edge 16 and a second edge 18, on the roof. A second sheet 20 of rubber roofing material with a first edge 22 and a second edge 24 is then unrolled with its first edge 22 overlapping the second edge 18 of the first sheet 14. The overlapping edge 22 of the second sheet 20 is then folded back to expose the overlapped second edge 18 of the first sheet 14 as shown in FIG. 1.

A roll of rubber roofing adhesive 26 is unrolled on an exposed overlapped second edge 18 of the first sheet 14 with a layer of separation film 28 facing upward. The separation film 28 is rolled up into a cylindrical roll 30 of separation film 28 using a separation film retriever 32. After the separation film 28 is removed, the upper surface 34 of the rubber roofing adhesive 26 is exposed. The folded over overlapping first edge 22 of the second sheet 20 is then unfolded and moved into contact with the upper surface 34 of the adhesive 26. A roller (not shown) is applied to an upper surface of the first edge 22 of the second sheet 20 to remove air and form a watertight seal between the first sheet 14 and the second sheet 20.

Figure 4:
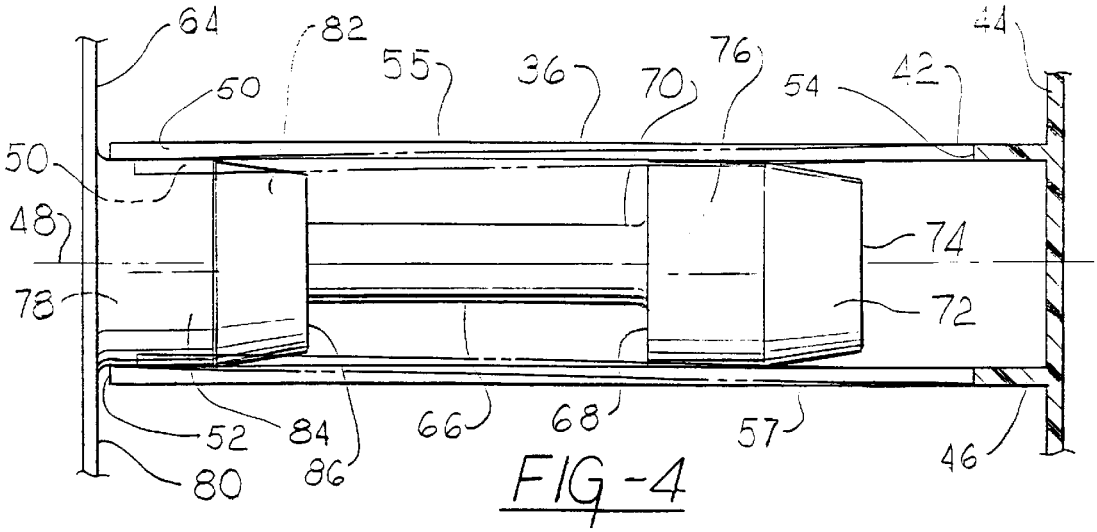
FIG. 4 is a sectional view of the spindle and both end plates.

The separation film retrieve 32 has a spindle 36, a hand crank 38 and a handle assembly 40. The spindle 36 includes a tubular member 42 with an axial length that is at least as long as the width of the widest separation film 28 that is to be retrieved. A first end plate 44 is secured to a first end 46 of the spindle 36 and is perpendicular to an axis of rotation 48 of the spindle. A plurality of slots 50 are formed in the spindle 36 and extend from a second end 52 of the spindle to slot ends 54 spaced from the first end 46 of the spindle. The slots 50 are parallel to the axis of rotation 48 and permit the spindle walls 55 on the second end 52 to be urged inward toward the spindle's axis of rotation and reduce spindle diameter as shown in phantom lines in FIG. 4.

The hand crank 38 is secured to the opposite side of the first end plate 44 from the spindle 36. The hand crank 38 includes a first arm 56 that is concentric with the axis of rotation 48 and extends axially from the first end plate 44 to a second arm 58 of the hand crank. The second arm 58 extends radially outward from the axis of rotation 48 and the first arm 56 to a third arm 60. The third arm 60 of the hand crank 38 extends axially parallel to the axis of rotation and away from the end plate 44. The outer surface 62 of the third arm 60 is a crank handgrip.

A second end plate 64 of the spindle 36 is fixed to a shaft 66. A first spindle support block 68 is mounted on an inside end 70 of the shaft 66. The first spindle support block 68 has a conical surface 72 that extends from a first end block end surface 74 to a cylindrical surface 76. The cylindrical surface 76 is concentric with the shaft 66 and has a diameter that is substantially the same as the inside diameter of the tubular member 42 of the spindle 36 before slots 50 are formed. A second spindle support block 78 is secured to shaft 66 and an inside surface 80 of the second end plate 64. The second spindle support block 78, like the first spindle support block 68, has a conical surface 82 and a cylindrical surface 84 that are concentric with the shaft 66. The cylindrical surface 84 is on the portion of the second spindle support block 78 that is adjacent to the second end plate 64 and has a diameter that is substantially the same as the diameter of the cylindrical surface 76 of the first spindle support block 68. The conical surface 82 has a large diameter end that joins the cylindrical surface 84 and extends axially to a small diameter end that intersects an end 86 of the second spindle support block 78. The end 86 faces away from the second end plate 64.

The cylindrical surfaces 76 and 84 support the spindle fingers 57, formed by the slots 50, during the winding of separation film 28 on the spindle 36. To remove a roll 30 of separation film 28 from the spindle 36, the spindle support blocks 68 and 78 are extracted from the inside of the spindle. This permits the spindle fingers 57 and the spindle walls 55 to move radially inward toward the axis of rotation 48. Reduction in the outside diameter of the spindle 36 permits a roll 30 to be easily removed from the spindle. Maximum reduction in spindle diameter, with minimal force, can be obtained if the cylindrical surfaces 76 and 84 have a diameter that is slightly larger than the inside diameter of the spindle 36 prior to forming the slots 50. An outside diameter of the cylindrical surfaces that is 1/16 of an inch larger than the inside diameter of the spindle 36 has been found to work well. However, if the fingers 57 are very flexible, the cylindrical surfaces 76 and 84 may be slightly smaller in diameter than the inside diameter of the spindle 36 and a roll 30 can still be removed with minimal force. With spindles 36 made from plastic pipe and having more than four slots 50, the cylindrical surfaces 76 and 84 may be a little larger in diameter, the same diameter or a little smaller in diameter than the inside diameter of the spindle.

A T-shaped handle 88 is secured to an end of the shaft 66 on the opposite side of the second end plate 64 from the first and second spindle support blocks 68 and 78. The T-shaped handle 88 is used to insert the first and second spindle support blocks 68 and 78 into the tubular member 42 as well as to extract both spindle support blocks from the tubular member.

The handle assembly 40 has a first radial arm 90, a second radial arm 92 and a transverse arm 94 that is parallel to the axis of rotation 48. The first radial arm 90 is jounaled on the first arm 56 of the hand crank 38 between the first end plate 44 and the second arm 58 of the hand crank. The second radial arm 92 is journaled on the shaft 66 between the second end plate 64 and the T-shaped handle 88. The transverse arm 94 is secured to the first and second radial arms 90 and 92.

A joint 96 is provided in the transverse arm 94 to permit the spindle support blocks 68 and 78 to be removed from the tubular member 42. The joint 96 includes a reduced diameter rod 98 that extends from the transverse arm 94 on one side of the joint 96 and is telescopically received in a bore in the transverse arm on the other side of the joint.

An optional handgrip 100 extends radially outward from the transverse arm 94 and away from the first and second radial arms 90 and 92. This handgrip 100 permits a person's wrist to be rotated 90° when holding the handgrip 100 from the position when holding the transverse arm 94 directly.

The separation film retriever 32 may be made from standard PVC pipe with the exception of the end plates 44 and 64, the outer gripping surface of the optional handgrip 100, and the spindle support blocks 68 and 78. The entire structure as shown in the drawing includes 90° elbows, T-shaped couplings and pipes with various diameters.

The cylindrical rolls 30 of separation film 28 are dense compact rolls. At least 200 linear feet of separation film 28 can be rolled up on the spindle 36 at one time. If the axial length of the spindle 36 is twice the width of the separation film 30 or longer, about 400 feet of separation film can be rolled up at one time by causing the strip of separation film 28 to move from one end plate 44 to the other end plate 64. The quantity of separation film 28 that can be rolled up in one roll 30 depends upon the diameter of the end plates 44 and 64 and the weight of the separation film to be held by a roofer. The distance from the spindle 36 to the transverse arm 94 can also limit the quantity of separation film held on the spindle. However it is generally not desirable to create a film roll 30 that substantially exceeds the diameter of the end plates 44 and 64.

The separation film retriever 32 was designed specifically to roll up separation film 28 removed from rubber roofing adhesive 26. However, it can be used to roll up any similar flexible material in a long strip.

The disclosed embodiment is representative of a presently preferred form of the invention, but is intended to be illustrative rather than definitive thereof. The invention is defined in the claims.

What is claimed is:

1. A sealing strip separation film retriever comprising:

a tubular spindle having a first end, a second end, an inside diameter, an outside diameter, a first end plate fixed to the first end of the tubular spindle, and a plurality of slots in the tubular spindle extending from the second end toward the first end of the spindle and forming a plurality of fingers;

a hand crank secured to the first end plate;

a shaft having an inside end and an outside end, a second end plate fixed to the shaft, and at least a first spindle support block mounted on the inside end of the shaft and having an outside diameter that is substantially the same as the inside diameter of the tubular spindle;

a handle rotatably connected to the spindle; and wherein the first spindle support block is telescopically received in the tubular spindle to limit deflection of the plurality of fingers toward an axis of rotation of the tubular spindle and the first spindle support block is removable from the tubular spindle.

2. A sealing strip separation film retriever as set forth in claim 1 including a second spindle support block mounted on the inside end of the shaft and separated from the first spindle support block.

3. A sealing strip separation film retriever as set forth in claim 1 wherein the handle is journaled on the hand crank adjacent to the first end plate and is journaled on the outside end of the shaft adjacent to the second end plate.

4. A sealing strip separation film retriever as set forth in claim 3 including a joint in the handle.

5. A sealing strip separation film retriever as set forth in claim 4 wherein the joint in the handle includes a bore and a rod that is telescopically received in the bore and wherein the axis of the rod is parallel to the axis of rotation of the tubular spindle.

6. A sealing strip separation film retrieve comprising:

a tubular spindle having a first end, a second end, an inside diameter, an outside diameter, and a plurality of slots in the tubular spindle extending from the second end toward the first end and forming a plurality of fingers;

a first end plate fixed to the first end of the tubular spindle;

a hand crank secured to the first end plate and extending axially away from the first end of the tubular spindle;

a shaft having an inside end and an outside end, a second end plate fixed to the shaft, a first spindle support block mounted on the inside end of the shaft and having a cylindrical surface with a cylindrical surface outside diameter that is substantially the same as the inside diameter of the tubular spindle and a truncated conical surface having a large diameter end with a large end diameter that is substantially the same as the cylindrical surface outside diameter and a small diameter end with a small end diameter that is spaced from the cylindrical surface;

a second spindle support block mounted on the inside end of the shaft between the second end plate and the first spindle support block and having a second block outside diameter that is substantially the same as the inside diameter of the tubular spindle;

a T-shaped handle secured to the outside end of the shaft for moving the first spindle support block into and out of the second end of the tubular spindle;

a support handle journaled on the hand crank adjacent to the first end plate and journaled on the outside end of the shaft adjacent to the second end plate; and a joint in the support handle.

7. A sealing strip separation film retriever as set forth in claim 6 wherein the joint in the support handle includes a bore in a first transverse arm portion, a rod extending from a second transverse arm portion and received in the bore and wherein a rod axis is parallel to a spindle axis of rotation.

8. A method of retrieving a sealing strip separation film with a separation film retriever including a tubular spindle with a first end plate and a second end plate comprising:

supporting said separation film retriever manually;

rotating the tubular spindle;

pulling the sealing strip separation film from a sealing strip deposited on a sheet of rubber roofing material;

winding the sealing strip separation film on the tubular spindle simultaneously with pulling the sealing strip separation film from the sealing strip;

removing a spindle support block from inside the tubular spindle and simultaneously removing the second end plate from the spindle;

sliding a wound roll of the sealing strip separation film from the tubular spindle;

inserting the spindle support block inside the tubular spindle to maintain spindle diameter; and securing the second end plate to the spindle.

* * * * *